US008540848B2

(12) United States Patent
Blankenborg et al.

(10) Patent No.: US 8,540,848 B2
(45) Date of Patent: Sep. 24, 2013

(54) METHOD AND DEVICE FOR A DE-ACIDIFYING PAPER

(75) Inventors: Stephanus Gerardus Johannes Blankenborg, Nijmegen (NL); Maaike Jacobine Esther Van Roosmalen, Delft (NL)

(73) Assignee: OmniAccess B.V., Uden (NL)

( * ) Notice: Subject to any disclaimer, the term of this patent is extended or adjusted under 35 U.S.C. 154(b) by 598 days.

(21) Appl. No.: 12/678,364

(22) PCT Filed: Sep. 17, 2008 (Under 37 CFR 1.47)

(86) PCT No.: PCT/NL2008/050609

§ 371 (c)(1), (2), (4) Date: Jul. 16, 2010

(87) PCT Pub. No.: WO2009/038459

PCT Pub. Date: Mar. 26, 2009

(65) Prior Publication Data

US 2011/0091641 A1 Apr. 21, 2011

(30) Foreign Application Priority Data

Sep. 17, 2007 (NL) ..... 2000862

(51) Int. Cl.
*D21H 11/00* (2006.01)

(52) U.S. Cl.
USPC ..... 162/265

(58) Field of Classification Search
USPC ..... 162/265; 427/439, 427, 296, 331, 427/377; 422/40, 300; 106/287.28
See application file for complete search history.

(56) References Cited

FOREIGN PATENT DOCUMENTS

| | | |
|---|---|---|
| FR | 2 825 726 | 12/2002 |
| WO | 97/39190 | 10/1997 |

OTHER PUBLICATIONS

FR 2825726, machine translation, Dec. 2002.*
International Search Report for corresponding International Application No. PCT/NL2008/050609 mailed Mar. 31, 2009.
Written Opinion for corresponding International Application No. PCT/NL2008/050609 mailed Mar. 31, 2009.

* cited by examiner

*Primary Examiner* — Mark Halpern
(74) *Attorney, Agent, or Firm* — Renner, Otto, Boisselle & Sklar, LLP

(57) ABSTRACT

For decades books and other paper documents have been deteriorating in archives and libraries around the world because the acidity of the paper is increasing so much (wherein the pH decreases) that the paper cellulose is decomposing so that the paper loses its cohesion and thereby degenerates in terms of quality. The invention relates to an improved method for de-acidifying paper. The invention also relates to a device for applying such a method.

12 Claims, 2 Drawing Sheets

METHOD AND DEVICE FOR A DE-ACIDIFYING PAPER

Figure 1:
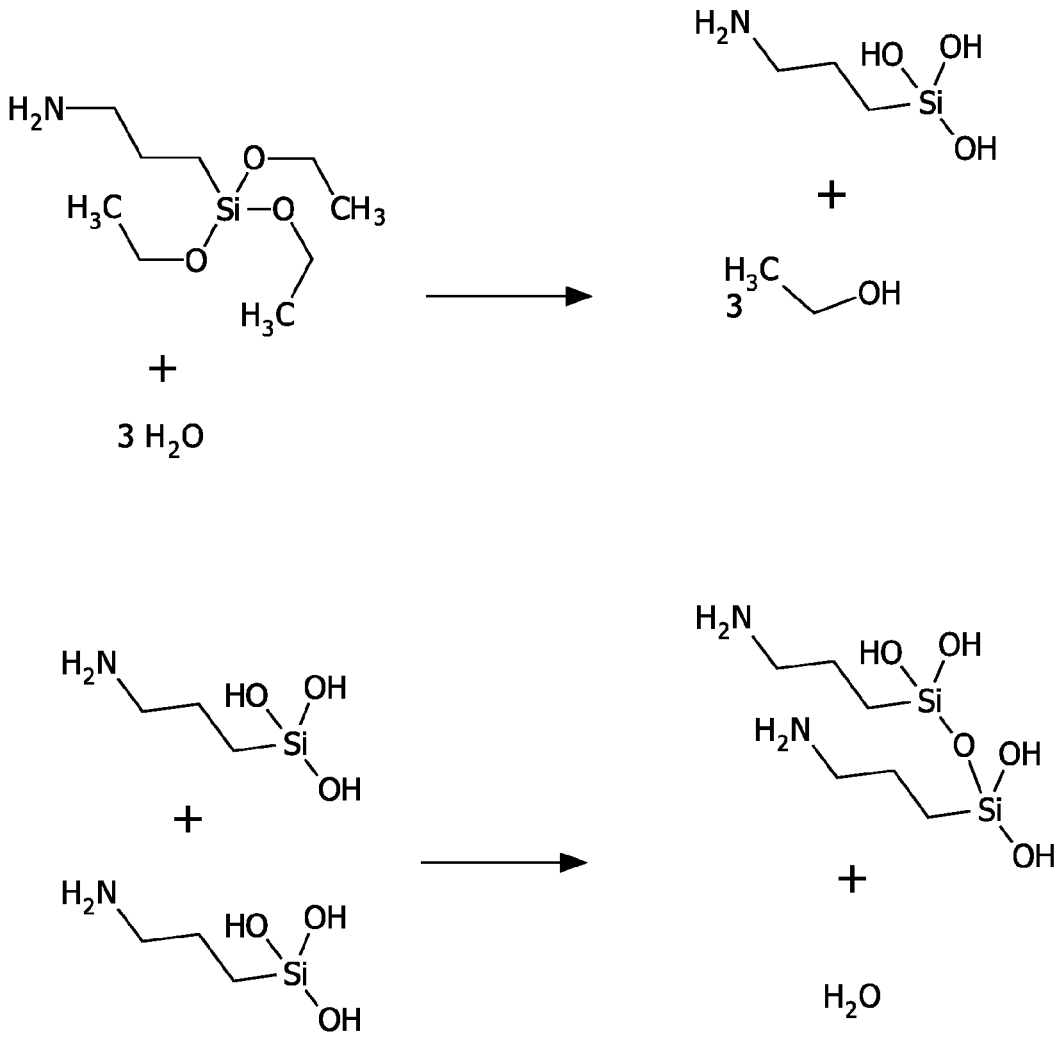

This application is a national phase of International Application No. PCT/NL2008/050609 filed Sep. 17, 2008 and published in the English language.

The invention relates to a method for de-acidifying paper. The invention also relates to a device for applying such a method.

For decades books and other paper documents have been deteriorating in archives and libraries around the world because the acidity of the paper is increasing so much (decrease in pH) that the cellulose of which the paper for the most part consists is decomposing, whereby the paper loses its cohesion and thereby degenerates in terms of quality. The cause of this acidification process goes back to the invention of mechanical paper manufacture around 1800. For the so-called sizing of the paper web to be formed the use of resin-alum provided with aluminium sulphate was found to be necessary. Sizing is necessary because unsized paper acts as tissue paper and cannot therefore be written on. Before 1800 the prepared sheets of paper were immersed in a gelatine solution and then dried in order to size hand-made paper. Resin-alum sizing was later found to have the great drawback that sulphuric acid is released. This sulphuric acid has a destructive effect on the cellulose, the main raw material of paper, while gelatine did not have this drawback. The demand for paper further became so great in the 19th century that the quantity of rags available as a source of cellulose became insufficient. From about 1850 other sources of cellulose were found, such as diverse types of wood, from which the non-cellulose constituents such as lignin or hemicellulose were removed by aggressive boiling processes. Lignin causes paper to go brown. Since they have already been affected quite seriously by the boiling processes, these treated cellulose types are however more susceptible to acidification than cellulose originating from linen and cotton rags. Different methods have been developed in the past for neutralizing the acids occurring in archive materials. Aqueous solutions provided with alkaline salts, such as calcium bicarbonate, magnesium bicarbonate and calcium hydroxide, have been found suitable for being able to de-acidify the paper, whereby decomposition of cellulose chains can be prevented. An important drawback of this known method is that wet paper loses a significant part of its strength, which can be disastrous for archive materials already in poor condition. Another drawback is the fact that in aqueous de-acidification of books the whole book must be taken apart, after which each page must be de-acidified and dried before they can be bound into a book again. These manual operations greatly increase costs. It has moreover been found that the degree of penetration of the neutralizing salts in the paper has been found insufficient to provide the paper with sufficient alkali reserve to be able to bring about a satisfactory de-acidification of the paper. In addition to the use of aqueous solutions, attempts have also been made to use organic liquids to improve the degree of penetration of the salts. An example hereof is the use of perfluoroheptane in the so-called "Bookkeeper process". The penetration of the neutralizing salts has however also been found to be not sufficiently satisfactory with the use of organic liquids.

The invention has for its object to provide an improved method for de-acidifying paper.

The invention provides for this purpose a method of the type stated the preamble, comprising the steps of: A) bringing the paper to be treated into contact with a fluid with an interfacial surface tension lower than 20 mN/m, in particular a supercritical fluid, which fluid is gaseous at room temperature and atmospheric pressure, wherein the fluid is provided with at least one alkaline alkoxy compound, in particular an aminoalkylalkoxysilane compound or a derivative thereof, whereby the paper is impregnated with the aminoalkylalkoxysilane compound or a derivative thereof, and B) ending the treatment according to step A), whereby the fluid is removed from the paper. Tests have shown that aminoalkylalkoxysilane compounds can be applied relatively efficiently to enable conservation of paper because the aminoalkylalkoxysilane compounds are adapted to adhere to the cellulose fibres of the paper. The aminoalkylalkoxysilane compounds will here generally undergo a hydrolysis reaction by reacting with water extracted from the paper and/or the surrounding area, whereby an aminoalkylalkoxysilane compound and at least one alcohol are formed. After this hydrolysis the formed aminoalkylalkoxysilane compounds will generally react with each other and/or react with cellulose, wherein water is released. As a result of this subsequent condensation a polymerized (aminoalkoxysilane) network is formed. The amino groups are here sufficiently alkaline to enable a neutralization of the aluminium sulphate present in the paper to be realized, whereby acidification of the paper can be prevented. In addition, the formation of the polymerized network brings about a strengthening of the paper, this being particularly advantageous in the case that relatively old and weak paper is being treated using the method according to the invention. Due to the formation of hydrogen bridges the network will moreover be bonded to the cellulose fibres. The formed alcohols can also be bonded to the cellulose fibres and/or the (polymerized) aminoalkoxysilane via hydrogen bridge formation, whereby the paper can be further strengthened. Although aminoalkylalkoxysilane compounds are thus particularly suitable for de-acidifying and strengthening paper, it has been found relatively difficult to impregnate the relatively non-polar aminoalkylalkoxysilane compounds in the paper. This is because the use of liquid ethanol as relatively non-polar solvent has the drawback that the impregnation of the aminoalkylalkoxysilane compounds in the paper is impeded as a result of the relatively high interfacial surface tensions of the solvent water (72.7 mN/m) or ethanol (22.3 mN/m), whereby the ethanol, and thereby the aminoalkylalkoxysilane compounds cannot penetrate sufficiently well into the paper. In addition, the use of ethanol as (component of the) fluid is undesirable since ethanol adversely affects, and usually even dissolves, the ink applied to the paper to be treated. The fluid as applied in the method according to the invention will therefore be alcohol-free. The values of the interfacial surface tensions stated in this patent apply at room temperature (20° C.). Research has shown that the impregnation of the aminoalkylalkoxysilane compounds can be significantly improved if a supercritical, and preferably substantially non-polar fluid is applied, or optionally a liquid fluid with an interfacial surface tension lower than 20 mN/m, preferably lower than 10 mN/m, more preferably lower than 5 mN/m. The supercritical phase of a fluid is a phase in which a distinction can no longer be made between the gas phase and liquid phase. It will generally only be possible to reach the supercritical phase of a fluid at an increased pressure, which is at least equal to the critical pressure, and at an increased temperature which is at least equal to the critical temperature. A supercritical fluid has the property of having no or at least a particularly low interfacial surface tension and (thereby) a relatively great penetrative capacity, whereby the supercritical fluid is highly suitable for allowing the aminoalkylalkoxysilane compounds to penetrate relatively well the paper to be treated. The supercritical medium moreover has a relatively great capacity to dissolve other substances compared to a gas, whereby the paper can be impregnated relatively efficiently and relatively quickly than if a gas were to be applied as carrier medium. The application of a fluid with a relatively low interfacial surface tension, in particular a supercritical fluid, has the particular advantage that one or more complete books can be treated in one operation. After impregnation with the aminoalkylalkoxysilane compounds the fluid, which can optionally also be provided with a fraction of aminoalkylalkoxysilane compounds, will then be removed from the paper in step B), which usually takes place in relatively simple manner by reducing the pressure, whereby the fluid will pass into the gas phase and can hereby be removed relatively easily from the paper. The temperature can optionally also be reduced to below the critical temperature, for instance room temperature. However, if only the temperature and not the pressure is reduced, the supercritical fluid will pass into a liquid phase, which will usually be undesirable because a separate drying of the paper is then usually necessary. A (substantial) part of the aminoalkylalkoxysilane compounds initially entrained by the supercritical fluid will remain in the paper to enable durable de-acidification and strengthening of the paper.

The fluid applied in the method according to the invention is gaseous at room temperature and under atmospheric pressure. In this way it is possible to prevent the fluid being provided with liquids, such as ethanol, which adversely affect the paper and/or the ink. In a preferred embodiment the supercritical fluid is formed by at least one of the following fluids: carbon dioxide, sulphur hexafluoride, ammonia, saturated hydrocarbons and nitrogen oxide. The use of carbon dioxide ($CO_2$) as supercritical fluid is particularly recommended because the aminoalkylalkoxysilane compounds can be entrained relatively well by carbon dioxide. Carbon dioxide is moreover chemically inert, harmless, non-flammable, odourless and disinfecting. In addition, carbon dioxide can be brought relatively easily into a supercritical phase because carbon dioxide already becomes supercritical at a pressure of at least 72.8 atmosphere and a temperature of 31.3° C. An operating temperature of just over 31.3° C. is relatively low, and does not adversely affect the quality of the paper. Instead of a supercritical fluid a liquid fluid, preferably brought under pressure, with an interfacial surface tension lower than 10 mN/m could also be applied. Fluids with such a relatively low interfacial surface tension usually have a satisfactory penetrative capacity, whereby paper could be impregnated in satisfactory manner with the aminoalkylalkoxysilane compound. An example of a liquid fluid with a relatively low interfacial surface tension is liquid carbon dioxide, which has an interfacial surface tension of about 5 mN/m.

The aminoalkylalkoxysilane compound is preferably formed by at least one of the following compounds: an aminoalkylmonoalkoxysilane compound, aminoalkyldialkoxysilane compound, aminoalkyltrialkoxysilane compound or a derivative thereof. The aminoalkyl group of the aminoalkylalkoxysilane compound preferably comprises at least ten carbon atoms, wherein the aminoalkyl group comprises one or more primary, secondary or tertiary amine compounds. The alkoxy group of the aminoalkylalkoxysilane compound preferably comprises one to five carbon atoms to enable optimization of the formation and the strength of the alkoxysilane network. Larger alkoxy groups could impede the formation of the polymeric network.

The aminoalkylalkoxysilane compound is preferably formed particularly by at least one of the following compounds: 3-aminopropyltrimethoxysilane, 3-aminopropylmethyl dimethoxysilane, 3-aminopropyltriethoxysilane, 3-aminopropylmethyldiethoxysilane, N-(2-aminoethyl)-3-aminopropylmethyldimethoxysilane, N-(2-aminoethyl)-3-aminopropyltrimethoxysilane, 4-aminobutyl-triethoxysilane, 4-amino-3,3-dimethylbutyl trimethoxysilane, (N,N-dimethyl-3-aminopropyl)-trimethoxysilane, (N,N-diethyl-3-aminopropyl)-trimethoxysilane, N-phenylaminopropyltrimethoxysilane, -(6-aminohexyl)-3-aminopropyltrimethoxysilane, bis[3-(trimethoxysilyl)propyl]amine or bis[3(triethoxysilyl)propyl]amine. The components are generally available commercially, from, among others, United Chemical Technologies Inc. (UCT).

The concentration of the aminoalkylalkoxysilane compound in the supercritical fluid for performing step A) preferably lies between 0.01 and 40 mol %, more preferably between 0.1 and 20 mol %. The use of a concentration within the above stated limits has the advantage that the paper is treated with an excess of the aminoalkylalkoxy compound so as to enable full de-acidification of the paper. Furthermore, not all the aminoalkylalkoxysilane initially entrained by the supercritical fluid will generally be deposited on the paper, but only a substantial part thereof, whereby an excess of the aminoalkylalkoxysilane compound is also applied to the paper. Part of the deposited alkaline material will almost immediately neutralize the already present acid. A possible excess of alkaline material forms a buffer with which future acidification can be prevented.

In order to be able to improve the solubility of the aminoalkylalkoxysilane compound in the supercritical fluid it is generally advantageous that the supercritical fluid is provided with a liquid intermediary solvent in which the aminoalkylalkoxysilane compound is dissolved or is present at least in suspension. The intermediary solvent is preferably formed by water. From a viewpoint of solubility the use of an alcohol is generally preferred to the use of water because the solubility of the aminoalkylalkoxysilane compound in alcohol is generally better, this however depending on the nature of the structure of the aminoalkylalkoxysilane compound. However, as stated above, an alcohol generally affects the ink applied to the paper to be treated, whereby water will be clearly preferred to alcohol as intermediary solvent. In the case an intermediary solvent is applied, an alcohol-free solvent will then preferably also be applied.

In a preferred embodiment the fluid is provided with at least one additive for performing step A). The at least one additive, which is entrained by the supercritical fluid in addition to the aminoalkylalkoxysilane compound, can be of diverse nature, but is preferably formed by one of the following components: a bleaching agent, an antioxidant, a disinfectant or a substance for preventing ink corrosion.

In a preferred embodiment step A) and step B) are repeated at least once after initially performing step A) and step B). The impregnation of the paper with the aminoalkylalkoxysilane compound can hereby usually be optimized. Before applying of the aminoalkylalkoxysilane compound to the paper as according to step A) is ended as according to step B), it is usually advantageous to measure the acidity of the paper. Step B) can herein be initiated for instance after detection that a determined pH value (acidity) of the paper or a determined increase in the pH value of the paper has been achieved.

The invention also relates to a device for applying a method according to the invention, comprising: compression means for generating a supercritical fluid and a substantially medium-tight pressure chamber connected to the compression means, which pressure chamber is adapted to receive paper and to hold a fluid provided with at least one aminoalkylalkoxysilane compound. The pressure chamber is preferably provided with detection means for detecting the pH value of the paper. On the basis of the pH value (increase) detected by the detection means the dosage of the quantity of fluid to be supplied to the pressure chamber can be regulated using a control unit. In another preferred embodiment the pressure chamber is provided with detection means for determining the concentration of the aminoalkylalkoxysilane compound in the pressure chamber. This concentration determination can take place on the basis of a detected pH value, although it is also possible in other manner, for instance via one or more (optical) sensors. Regulating the supply of the fluid enriched with the at least one aminoalkylalkoxysilane compound to the pressure chamber using the control unit can also take place on the basis of the concentration of the aminoalkylalkoxysilane compound detected in the pressure chamber. The device preferably comprises means for keeping the fluid in the pressure chamber in motion, whereby the impregnation of the paper can be intensified. It is also possible to envisage pre-flushing the pressure chamber with the supercritical medium before the supercritical medium is provided with the alkaline alkoxy compound, in particular the aminoalkylalkoxysilane compound, in order to enable pre-cleaning and optionally drying of the paper present in the pressure chamber.

Figure 2:
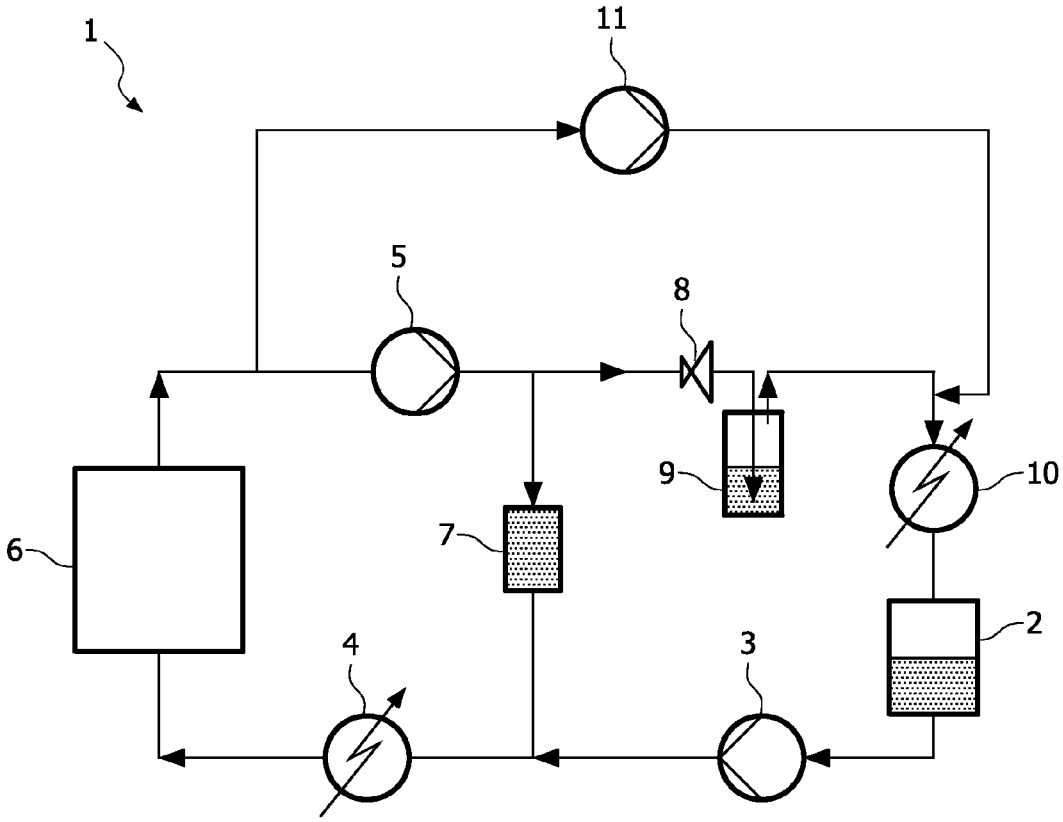

The invention will be elucidated with reference to non-limitative exemplary embodiments shown in the following figures. Herein:

FIG. 1 shows a reaction equation of the hydrolysis and subsequent condensation of an aminoalkylalkoxysilane compound as applied in the method according to the invention, and FIG. 2 shows a schematic view of a device for applying the method according to the invention.

FIG. 1 shows a reaction equation of the hydrolysis and subsequent condensation of an aminoalkylalkoxysilane compound as applied in the method according to the invention. FIG. 1 more particularly shows that 3-aminopropyltriethoxysilane (APTES) will hydrolyse under the influence of water while forming 3-aminopropylsilanetriol and ethanol. The 3-aminopropylsilanetriol compound will then react (condense) with other aminopropylsilanetriol compounds and/or with cellulose chains of the paper to be treated, whereby a polymerized network is formed which strengthens the paper.

FIG. 2 shows a schematic view of a device 1 for applying the method according to the invention. Device 1 comprises a supply container 2 for liquid carbon dioxide. The pressure of the liquid carbon dioxide will be increased by means of a pressure pump 3 until the liquid carbon dioxide reaches the supercritical phase. The supercritical phase can be stabilized by heating the supercritical carbon dioxide by means of heating means 4. The supercritical carbon dioxide can be guided through a de-acidification chamber 6 and a supply container 7 for 3-aminopropyltriethoxysilane (APTES) by means of a circulation pump 5. The paper for de-acidifying will be placed in de-acidification chamber 6. By guiding the supercritical carbon dioxide through supply container 7 for 3-aminopropyltriethoxysilane, the 3-aminopropyltriethoxysilane can be entrained with the supercritical carbon dioxide and in this manner guided through de-acidification chamber 6. In de-acidification chamber 6 the supercritical carbon dioxide provided with 3-aminopropyltriethoxysilane will penetrate the paper, wherein 3-aminopropyltriethoxysilane will be deposited on the paper. After sufficient supply of 3-aminopropyltriethoxysilane to de-acidification chamber 6 a valve 8 can be opened, whereby the pressure in device 1 will fall such that the carbon dioxide will evaporate and substantially disappear from device 1. A fraction of 3-aminopropyltriethoxysilane possibly left in the carbon dioxide can be collected in a separator 9. After evaporation of the carbon dioxide the carbon dioxide is made liquid again in a condenser 10 and then guided back into the supply container for carbon dioxide 2. Device 1 is also provided with suction means 11 for emptying device 1 after use, wherein the suctioned-out carbon dioxide will be fed to condenser 10 so that as much carbon dioxide as possible can be reused in a subsequent de-acidification process, this being advantageous from an economic viewpoint.

It will be apparent that the invention is not limited to the exemplary embodiments shown and described here, but that numerous variants which will be self-evident to the skilled person in the field are possible within the scope of the appended claims.

The invention claimed is:

1. Method for de-acidifying paper, comprising the steps of:

A) bringing the paper to be treated into contact with liquid carbon dioxide or supercritical carbon dioxide, wherein the fluid liquid carbon dioxide or supercritical carbon dioxide is provided with at least one alkaline alkoxy compound comprising an aminoalkylalkoxysilane compound or a derivative thereof, whereby the paper is impregnated with the aminoalkylalkoxysilane compound or a derivative thereof, and B) ending the treatment according to step A) by reducing the pressure, whereby the liquid carbon dioxide or supercritical carbon dioxide is passed into the gas phase and is removed from the paper.

2. Method as claimed in claim 1, wherein step A) is performed at a temperature and pressure which are equal to or higher than the critical temperature and the critical pressure of carbon dioxide.

3. Method as claimed in claim 1, wherein the aminoalkylalkoxysilane compound is formed by at least one of the following compounds: an aminoalkylmonoalkoxysilane compound, aminoalkyldialkoxysilane compound, aminoalkyltrialkoxysilane compound or a derivative thereof.

4. Method as claimed in claim 1, wherein the aminoalkyl group of the aminoalkylalkoxysilane compound comprises at least ten carbon atoms.

5. Method as claimed in claim 1, wherein the alkoxy group comprises one or two carbon atoms.

6. Method as claimed in claim 1, wherein the aminoalkylalkoxysilane compound is formed by at least one of the following compounds: 3-aminopropyltrimethoxysilane, 3-aminopropylmethyldimethoxysilane, 3-aminopropyltriethoxysilane, 3-aminopropylmethyldiethoxysilane, N-(2-aminoethyl)-3-aminopropylmethyldimethoxysilane, N-(2-aminoethyl)-3-aminopropyltrimethoxy silane, 4-aminobutyl-triethoxysilane, 4-amino-3,3-dimethylbutyltrimethoxysilane, (N,N-dimethyl-3-aminopropyl)-trimethoxysilane, (N,N-diethyl-3-aminopropyl)-trimethoxysilane, N-phenylaminopropyltrimethoxysilane, -(6-aminohexyl)-3-aminopropyltrimethoxysilane, bis[3-(trimethoxysilyl)propyl]amine or bis[3(triethoxysilyl)propyl]amine.

7. Method as claimed in claim 1, wherein the concentration of the aminoalkylalkoxy compound in the carbon dioxide for performing step A) lies between 0.01 and 40 mol %.

8. Method as claimed in claim 1, wherein the carbon dioxide is provided with at least one additive for performing step A).

9. Method as claimed in claim 8, wherein the additive is formed by at least one of the following components: a bleaching agent, an antioxidant, a disinfectant or a substance for preventing ink corrosion.

10. Method as claimed in claim 1, wherein step B) is realized by reducing the pressure to atmospheric pressure.

11. Method as claimed in claim 1, wherein step B) is realized by reducing the temperature to room temperature.

12. Method as claimed in claim 1, wherein step A) and step B) are repeated at least once after initially performing step A) and step B).

* * * * *

UNITED STATES PATENT AND TRADEMARK OFFICE

CERTIFICATE OF CORRECTION

PATENT NO. : 8,540,848 B2
APPLICATION NO. : 12/678364
DATED : September 24, 2013
INVENTOR(S) : Blankenborg et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 720 days.

Signed and Sealed this
Fifteenth Day of September, 2015

Michelle K. Lee

Michelle K. Lee
*Director of the United States Patent and Trademark Office*